United States Patent [19]

Östbo

[11] 4,157,078

[45] Jun. 5, 1979

[54] VERTICAL BOILER

[76] Inventor: Nils Östbo, Volrat Thamsgatan 4, Göteborg, Sweden, 41278

[21] Appl. No.: 884,564

[22] Filed: Mar. 8, 1978

Related U.S. Application Data

[63] Continuation-in-part of Ser. No. 845,972, Oct. 27, 1977.

[30] Foreign Application Priority Data

Nov. 11, 1976 [SE] Sweden ..... 7612551
Nov. 11, 1976 [SE] Sweden ..... 7612552

[51] Int. Cl.[2] ..... F22B 7/12
[52] U.S. Cl. ..... 122/182 S
[58] Field of Search ..... 122/DIG. 1, 121, 122, 122/182 R, 182 S, 182 T

[56] References Cited

U.S. PATENT DOCUMENTS

| | | | |
|---|---|---|---|
| 1,992,794 | 2/1935 | Woodruff | 122/182 |
| 2,787,256 | 4/1957 | Ilune | 122/182 |
| 3,638,622 | 2/1972 | Ostbo | 122/182 |

FOREIGN PATENT DOCUMENTS

| | | | |
|---|---|---|---|
| 237645 | 12/1964 | Austria | 122/182 |

*Primary Examiner*—Kenneth W. Sprague
*Attorney, Agent, or Firm*—Cantor and Singer

[57] ABSTRACT

A vertical steam or hot water boiler includes a convection part enclosed in a drum, and has a final combustion chamber attached thereto. The convection part includes at least two groups of smoke tubes. An annular box structure encloses either, or both, of said groups, at the ends of the tubes adjacent to the final combustion chamber, and the box structure being provided with an inlet and an outlet for a boiler fluid. This fluid may be feed water or steam to be superheated.

4 Claims, 2 Drawing Figures

VERTICAL BOILER

This application is a continuation-in-part of Ser. No. 845,972 filed on Oct. 27, 1977.

BACKGROUND OF THE INVENTION

The present invention refers to a steam or hot water boiler comprising a convection part surrounding a flame tube, and a final combustion chamber forming an extension of the flame tube, but located outside the convection part, the latter being formed as a cylindrical drum having plane end plates, within which at least two groups of smoke tubes are arranged concentrically around the flame tube, and the water cooled wall of the final cobustion chamber is connected to the adjacent end plate of the drum, between two groups of smoke tubes.

The aim of the invention is to heat, in a simple and inexpensive manner, a boiler fluid, above what is ordinarily obtainable directly in a convection part. A further aim is to promote circulation of the water within the convection part, while simultaneously, in a steam boiler, protect the portion of the flame tube passing through a steam dome located within the convection part.

SUMMARY OF THE INVENTION

A boiler according to the invention includes at least one annular box structure enclosing the ends of one group of smoke tubes, at the ends thereof extending towards the final combustion chamber and provided with an inlet and an outlet for a boiler fluid.

The boiler fluid may be the feed water supplied to the boiler, and on such occasion the box structure surrounds an outer group of smoke tubes and is connected to a source of feed water supply, its outlet being open directly into the drum. In this manner it will be possible to lower the temperature of the combustion gases, before they leave the boiler proper, and dispense with any external economiser.

The boiler fluid may be steam leaving the boiler and on such occasion the box structure surrounds the innermost group of smoke tubes, its inlet and outlet, respectively, being connected to conduits conveying steam from a steam drum at the boiler, out of the boiler. As there are at least two groups of smoke tubes the boiler may evidently, simultaneously be provided with box structures permitting feed water heating, as well as steam superheating.

BRIEF DESCRIPTION OF SOME PREFERRED EMBODIMENTS

Figure 1:
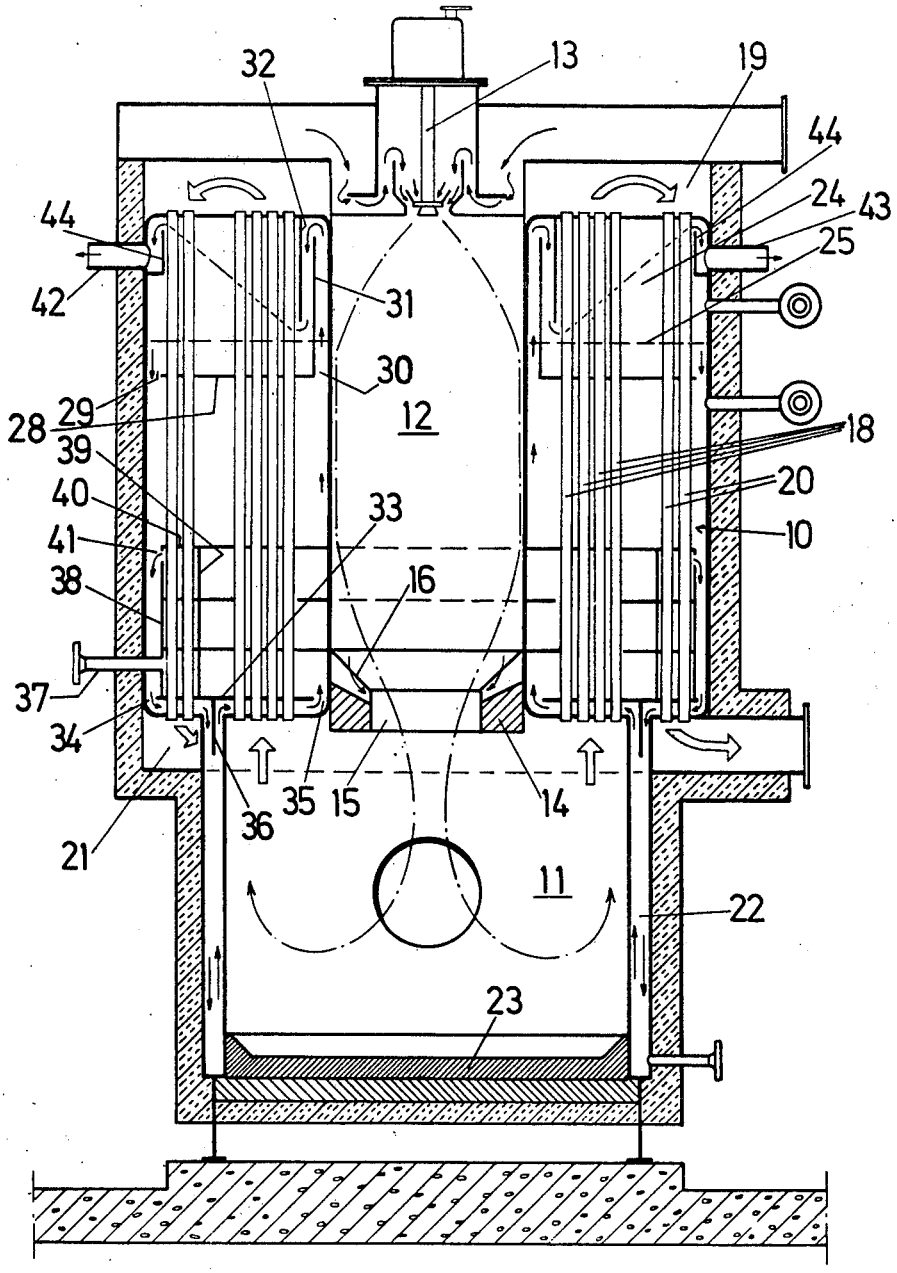
FIG. 1 is a vertical section through a steam boiler provided with feed water heating means according to the invention.

The steam boiler shown in FIG. 1 is of a basically well known type, and includes an upper, cylindrical portion 10 and a lower final combustion chamber 11. A fire tube 12 is fitted centrally within the upper portion, and is in its upper end provided with a burner 13. The lower end of the fire tube is defined by a wall formed by a body 14 of refractory material and having an outlet passage 15.

Those parts of the flame, which pass along the envelope wall of fire tube 12, will be cooled, so the combustion there will not be complete. Due to the shape of the top surface 16 of the refractory body 14, which slopes towards outlet passage 15, the peripheral parts of the flame will be forced into the core of the flame, immediately at the passage. An intense heating and a thorough mixing occurs, so an efficient final combustion is brought about in chamber 11.

The upper, cylindrical portion 10 includes a number of smoke tubes arranged in two concentric groups. The inward of these groups 18 extends between the final combustion chamber 11 and an upper turning chamber 19, while the outward group 20 of smoke tubes extends downwards from the latter to a lower collecting chamber 21, which is connected to a flue passage (not shown). The number of smoke tubes within each group is selected so the flow velocity of the gas, in spite of the reduced volume due to cooling, will be substantially the same.

The final combustion chamber 11 is outwardly defined by a water cooled wall 22, which is connected to the upper portion 10, intermediate the two groups 18 and 20 of smoke tubes. The bottom structure 23 of the final combustion chamber is here made of refractory material but may, in bigger, or highly loaded boilers also be water cooled.

The steam drum 24 is formed within the cylindrical portion 10, and will thus enclose the upper end of the fire tube. The water level during normal operation is denoted by 25.

In order to provide an adequate cooling of the upper end of flame tube 12, located within steam dome 24, an annular plate 28 is fitted horizontally within the water space of the drum, sufficiently below, normal water level 25 to be covered by water, also at lowest water level. Plate 28 is dimensioned so as to permit an annular passage 29 between its outer periphery and the envelope wall of drum 10, as well as a further annular passage 30 between its inward periphery and flame tube 12.

An upwardly directed baffle 31 is connected to plate 28 at its inward periphery and defines an extension of passage 30. This baffle extends almost to the upper end plate of drum 10.

An annular baffle 32 is attached to the upper end plate of drum 10 and extends downwardly, in parallel to baffle 31, terminating just above normal water level 25.

The mixture of water and steam bubbles, rising through the convection portion drum will be caught by plate 28, and be forced inwards to passage 30, where the mixture rapidly passes upwards between flame tube 12 and baffle 31. The upper portion of the flame tube will thus not be in direct contact with the steam in the steam drum, but will be continuously swept by a mixture of water and steam, which ensures a satisfactory cooling. In order to promote the flow inwards plate 28 may be slightly vaulted.

Baffle 32 aids in separating the steam from the water, a return flow of the water occuring by way of the outer passage 29.

In order to provide satisfactory water circulation conditions with drum 10 a similar guiding device for the water is provided in its lower portion.

A second annular plate 33 is fitted in parallel to, but spaced from the lower end plate of the drum. Also here there is a passage 34 at the outer periphery of the plate, and a further passage 35 at its inward periphery. A downwardly directed baffle 36 is attached to plate 33 and extends downwardly into water cooled wall 22, about centrally thereof.

A feed water supply conduit is denoted by 37. Two cylindrical plate walls 38 and 39 are attached to plate 33, and extend upwards therefrom, encircling the lower portions of the smoke tubes in group 20. Plate wall 39 is slightly higher than plate wall 38. A cover plate 40 defines, upwardly, the space enclosed by wall plates 38 and 39, and forms, together with the other plates a boxlike structure surrounding the lower ends of smoke tubes 20. This space communicates with the water within drum 10, by way of a passage 41 formed between the outer wall plate 38 and top plate 41.

Feed water supplied by way of conduit 37 will enter this chamber and be heated by extracting heat from smoke tubes 20. The water flows out through passage 41, close by the envelope wall of drum 10. In this manner it is possible to obtain a far better cooling of the escaping combustion gases, than would be the case if the boiling water within the drum had flown around these tube portions.

The feed water leaving passage 41 is, however, still cooler than the average of the water within the drum and tends to sink towards the passage between the envelope wall of drum 10 and wall plate 38. The water will then pass in below horizontal plate 33, and by baffle 36 be directed downwards along the outward boundary of water cooled wall 22. The inner wall thereof is subjected to radiation from the final combustion chamber 11, and here an intense heating of the water will occur. In this manner a stratified circulation is obtainable within the water cooled wall 22, the heated water flowing upwards and being directed towards the inner portion of plate 33 by baffle 36, so it can pass upwards through the inward passage 35.

Plate 33 forms part of the chamber where the primary heating of the feed water occurs.

As is mentioned above water will flow downwards through the outer passage 29 at upper plate 28, and by means of this plate and plate 33 conditions ensuring an advantageous circulation of the water within the large space within the drum are provided. The water flowing below plate 33 and out through passage 35 further provides a good cooling of the portion of the lower end plate, where the inward group 18 of smoke tubes and flame tube 12 are attached.

Steam is withdrawn from steam drum 24 by two fittings 42 and 43. Inside of the attachment thereof there is an annular baffle plate 44. In this manner an even flow of steam is obtained, as well as a satisfactory distribution of heat.

Figure 2:
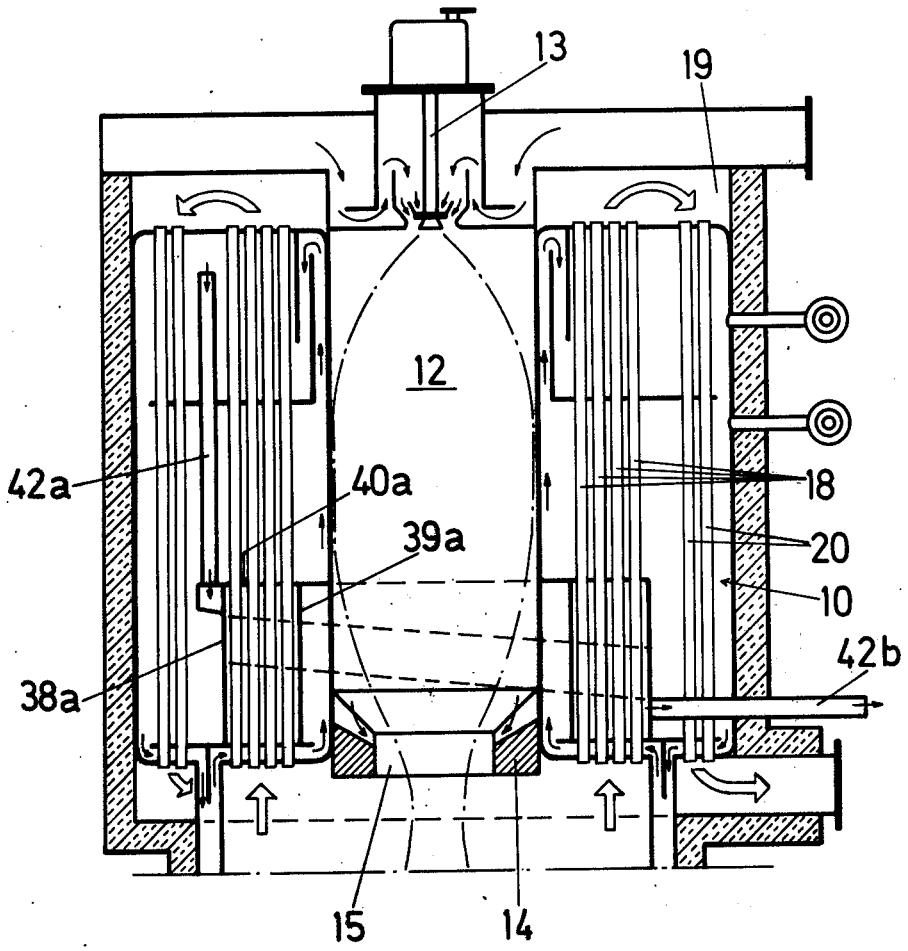
FIG. 2 shows the upper portion of a steam boiler having a steam superheater according to the invention.

FIG. 2 shows a steam boiler provided with a steam superheater. Also here the annular box structure is based upon annular plate 33, and further comprises two wall plates 38*a* and 39*a*, as well as a cover plate 40*a*, which together form an annular box structure, encircling the upward group 18 of smoke tubes, at the lower ends thereof.

Steam is conveyed from steam dome 24 by one or more vertical pipes 42*a*, within convection drum 10, said pipes being open in their upward ends and connected to cover plate 40*a* of the box structure. This is, by means of internal baffle plates subdivided so the steam will have to pass along a helical path around flame tube 12, and leaves the box structure by way of a pipe 42*b*.

In order to prevent a local overheating of the plate material when starting up the boiler the box structure is preferably initially filled with water. This may be brought about by temporarily permitting the water level within drum 10 to rise above the upper end of pipes 42*a*. Possibly remaining water may be drained through pipe 42*b*, before steam is withdrawn for consumption.

The transfer of steam from the dome to the box structure may alternatively be arranged by means of the fitting 42 and 43 shown in FIG. 1 and external downcomers. As mentioned initially it is, according to the invention, possible to provide feed water heating and steam superheating at the same boiler.

What I claim is:

1. In a vertical boiler comprising a convection part and a final combustion chamber aligned therewith;

a drum defined by a cylindrical envelope wall and upper and lower plane end walls, and enclosing a water space, a flame tube located centrally within said drum, and extending between the end plates thereof, said flame tube having burner means at its end at said upper end plate and communicating with said final combustion chamber at its opposite end, at least two groups of smoke tubes arranged concentrically, one outside the other, around said flame tube, extending between said end plates, an inward of said at least two groups communicating wth said final combustion chamber, a turning chamber located outside said upper end plate for communicating said at least two groups of smoke tubes, a smoke gas outlet communicating with an outward of said at least two groups of smoke tubes, a water cooled wall defining said final combustion chamber, and communicating with the water space within said drum, intermediate the inward and the following group of said at least two groups of smoke tubes, and at least one annular box structure enclosing one of said groups of smoke tubes, at the end thereof adjacent to said lower end plate, and being provided with an inlet and an outlet transferring a boiler fluid.

2. The boiler according to claim 1, in which the box structure surrounds an outer group of smoke tubes and is connected to a source of feed water supply, its outlet being open directly into the drum.

3. The boiler according to claim 1 having a steam dome in which the box structure surrounds the innermost group of smoke tubes, its inlet and outlet, respectively, being connected to conduits conveying steam from a steam dome at the boiler, out of the boiler.

4. The boiler according to claim 1 having a steam dome within the drum of its convection part, and further including an annular plate mounted in parallel to said upper end plate, just below the water level separating the steam dome from the water space within said drum, said plate defining an inward passage between its inner periphery and said flame tube and an outer passage between its outer periphery and the envelope wall of said drum, as well as an upwardly directed cylindrical baffle, concentric with said flame tube, and forming an extension of said inward passage .

* * * * *